US005532780A

United States Patent [19]

Fyson

[11] Patent Number: 5,532,780

[45] Date of Patent: Jul. 2, 1996

[54] PHOTOGRAPHIC PROCESSING METHOD USING A CARTRIDGE

[75] Inventor: John R. Fyson, Hackney, United Kingdom

[73] Assignee: Eastman Kodak Company, Rochester, N.Y.

[21] Appl. No.: 463,328

[22] Filed: Jun. 5, 1995

[30] Foreign Application Priority Data

Sep. 10, 1994 [GB] United Kingdom ..... 9418281
Apr. 5, 1995 [GB] United Kingdom ..... 9507055

[51] Int. Cl.[6] ..... G03D 3/02

[52] U.S. Cl. ..... 354/324; 354/331; 354/336; 354/322

[58] Field of Search ..... 354/298, 322–324, 354/331, 336; 210/95, 662, 282; 222/132; 430/30, 398–400

[56] References Cited

U.S. PATENT DOCUMENTS 2,935,194 5/1960 Tomkin ..... 210/95
4,734,728 3/1988 Müller ..... 354/324
4,801,961 1/1989 Hirai et al. ..... 354/324 X
5,110,479 5/1992 Frommer et al. ..... 210/662
5,347,336 9/1994 Yamada et al. ..... 354/324

FOREIGN PATENT DOCUMENTS 2647919 12/1990 France ..... 354/324
62-288840 12/1987 Japan ..... 354/323

*Primary Examiner*—D. Rutledge
*Attorney, Agent, or Firm*—J. Lanny Tucker

[57] ABSTRACT

A photographic processing machine having at least two processing tanks for holding different processing solutions and a removable container (100) containing working strength processing solutions and a washing-stabilizing solution in separate sub-containers therein from which the processing tanks are fed, wherein the last sub-container that feeds the washing-stabilizing tank comprises an ion-exchange resin, an indicator means capable of undergoing a color change when, the ion-exchange resin is exhausted.

17 Claims, 1 Drawing Sheet

PHOTOGRAPHIC PROCESSING METHOD USING A CARTRIDGE

FIELD OF THE INVENTION

This invention relates to photographic processing apparatus and to a method of determining when a batch of processing solution(s) needs replacing.

BACKGROUND OF THE INVENTION

Many known small photographic processing machines are supplied with processing solutions by means of a cartridge or cassette of ready-made working strength solution(s). For example, such a multiple cartridge could comprise a color developer solution, a bleach- fix solution and two or three wash and/or stabilizer solutions. Such containers can also contain filter or treatment means. Often such cartridges are returned to the manufacturer for recycling or disposal.

PROBLEM TO BE SOLVED BY THE INVENTION

If the cartridge is to be used in a batch mode, that is supplying a certain amount of a processing solution in order to process a certain area of photographic material before it is discarded, it is not clear when to replace this cartridge. Too early would be wasteful as, in some instances, the average use is better than the worst case. Too late would cause the processing to go out of control and produce undesirable results. More particularly, this happens if the final wash water is contaminated by seasoned bleach-fix carried in from a previous bleach-fix bath, on the processed material surface. If the amount of bleach-fix becomes too high in the final wash tank, the developed images produce stain after keeping. When the final wash is too contaminated, the cartridge should be discarded or returned to a suitable site for regeneration. Merely counting the number of sheets or lengths processed and calculating the "worst case" scenario could result in leaving serviceable solutions in the container. Such a scenario, for example, might assume that every frame is fully exposed thus requiring maximum amounts of developer and bleach-fix. An ion exchange resin can also be included in the final wash tank of such a processor, as described in European Patent Application No 500,592, in order to prolong the life of the cartridge as it removes contaminants carried in until the resin is exhausted. Once the resin is exhausted, the print staining contaminants build up, the above mentioned problems arise and the cartridge must be discarded or regenerated.

In such processes where these cartridges are used to supply processing reagents in a batch mode, a means of detection of the end of usefulness of the ion exchange resin used in processing solution or final wash is therefore needed.

SUMMARY OF THE INVENTION

According to the present invention, there is provided a method of processing imagewise exposed photographic materials in a processing machine comprising at least two processing tanks including a final stabilizing and washing tank, and a removable container containing at least one working strength solution with processing reagent(s) therein, and a final stabilizing and washing solution in separate sub-containers from which the processing tanks are fed, characterized in that the sub-container that contains the final stabilizing and washing solution comprises (a) an ion-exchange resin, and (b) an indicator means capable of undergoing a color change when the ion exchange resin is exhausted.

According to one embodiment, the color change is visually detected, or it is recorded by means of a color detecting sensor. In this latter case, the method of the invention can comprise the use of an additional means coupled with the color detecting sensor, for signaling the need for changing or regenerating the ion exchange resin.

Additionally, the present invention provides a photographic processing apparatus comprising at least one processing tank for holding a processing solution, a processing tank containing a final washing solution, and a removable container containing at least one working strength processing solution and a final washing solution with an ion exchange resin and an indicator, in separate sub-containers, each solution being circulated through the processing tanks and their corresponding sub-containers respectively.

The present invention solves the problem of detecting the amount of bleach-fix in the final wash tank by using an ion exchange resin with an indicator that shows when the resin is exhausted.

ADVANTAGEOUS EFFECT OF THE INVENTION

The processing solution container is changed neither too early nor too late, thus (a) saving waste and improving the life of the cartridge over the worst case scenario in the former case and (b) improving the quality of the processing in the latter case, for instance when the squeegees have deteriorated.

When loss by evaporation is small (which is usually the case in small processing machines or minilabs), particularly good results are obtained.

DETAILED DESCRIPTION OF THE INVENTION

Figure 1:
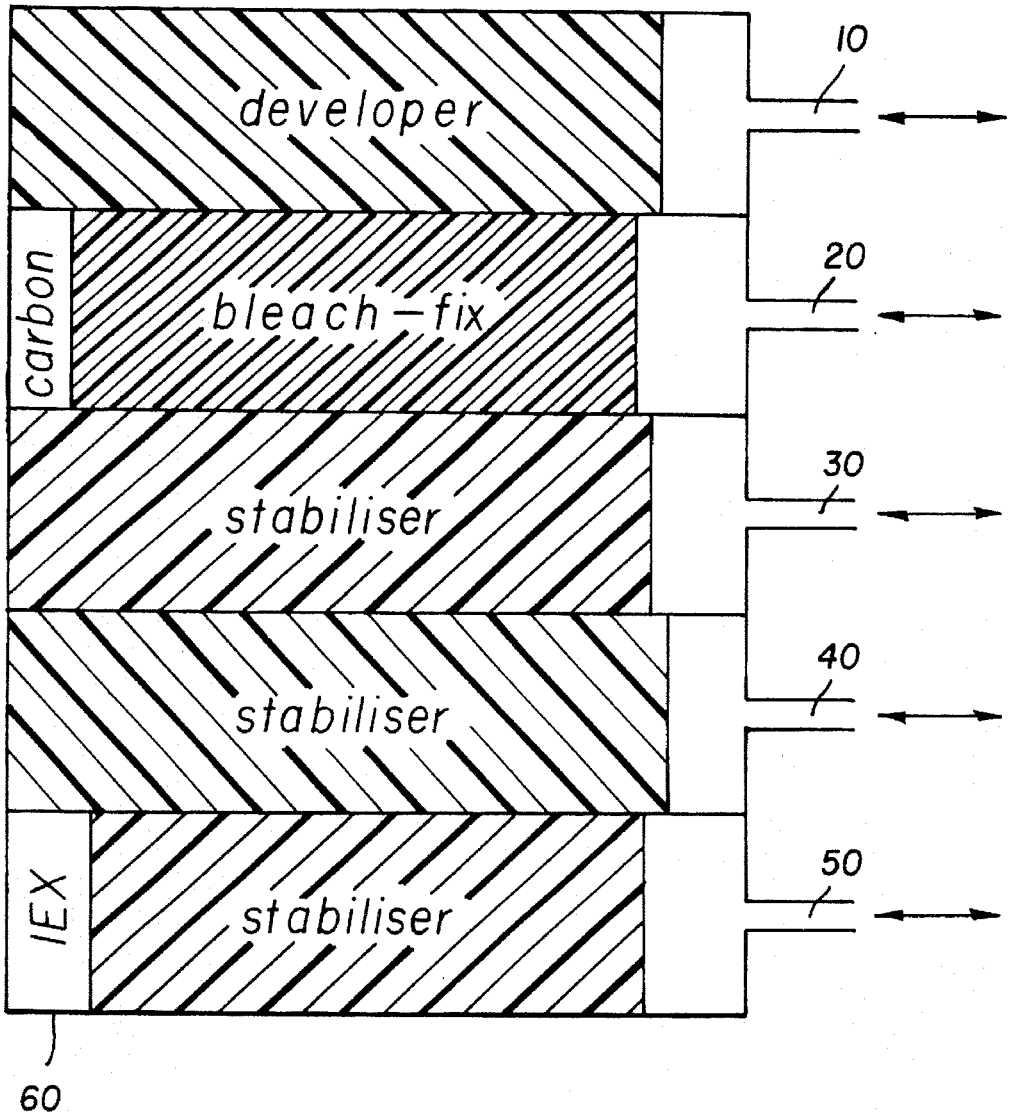
FIG. 1 of the accompanying drawing shows a multicontainer processing solution pack.

According to the invention, an ion exchange resin is located in the final sub-container containing the washing and stabilizing solution. The resin can be of the cationic, anionic or mixed bed type, that is capable of exchanging anions, cations or both types of ions present in the liquid in the sub-container. Two or more resins of different types may be combined in a layered system or mixed together. When the pH of the ion exchange resin reaches a predetermined value, the indicator would indicate that the resin has deteriorated and, as a result, that the tank's contents are outside acceptable limits. The predetermined value is established by routine experiment.

The indicator means may be a pH indicator dye producing, at a given pH, a color change that can be viewed by the operator, or recorded by a sensor. Suitable indicator dyes can be Bromophenol blue, Methyl orange, Brom cresol green, Methyl red, etc.

The present invention is applicable to small processing machines, especially those known as minilabs or microlabs. Such machines are designed to be operated by someone without much knowledge of processing chemistry and are therefore as automatic as possible. A paper processing machine would normally comprise develop and bleach-fix tanks with one or more wash or stabilize tanks.

The process may comprise the steps of:

(a) color development, (b) bleaching, and (c) fixing, followed by one or more wash or stabilizer steps, or a similar method in which the bleach and fix baths are combined into a single bleach-fix bath. A sub-container feeding a tank used after the image-forming step(s) can contain activated charcoal to remove unwanted processing chemicals, for example, color developing agent.

In a particular embodiment, the bleach-fix sub-container contains activated charcoal to remove unwanted color developer carry-over while the last washing stabilizer sub-container, in addition to the electrical detector, contains an ion exchange resin.

In particular, a mixture of anionic and cationic ion exchange resins can be employed.

Alternatively the process may comprise the steps of:

(a) development, and (b) fix, followed by one or more wash or stabilizer steps. The developer would typically be a black-and-white developer.

A further alternative would be in the case of a redox amplification process in which the first bath is a redox amplification bath or, especially, a redox developer-amplifier bath. Such amplification processes are well known. Redox amplification processes have been described, for example in British Specification Nos. 1,268,126, 1,399,481, 1,403,418 and 1,560,572. In such processes, color materials are developed to produce a silver image (which may contain only small amounts of silver) and then treated with a redox amplifying solution (or a combined developer-amplifier) to form a dye image.

The developer-amplifier solution contains a color developing agent and an oxidizing agent that will oxidize the color developing agent in the presence of the silver image that acts as a catalyst. Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

The materials to be processed and the processes to be used are described in Research Disclosure Item 308119, December 1989, published by Kenneth Mason Publications, Emsworth, Hants, United Kingdom.

The present invention can be used to process both color and black and white photographic materials using the appropriate processing steps and compositions.

In the accompanying drawing, FIG. 1 shows schematically a removable container containing working strength processing solutions in 5 separate subcontainers. Cartridge 100 contains sub-containers that respectively contain the processing solutions: developer, bleach-fix, stabilizer, stabilizer and the final wash-stabilizer. Each solution is supplied to the appropriate processing tank and returned via tubes by circulation means, e.g., a pump, not shown. The last stabilizer sub-container contains an ion exchange resin (60) to remove ionic species carried over from previous bath. The ion exchange resin contains a dye indicator that undergoes a color change when the resin needs regeneration or replacement, i.e., when the bath is too enriched in contaminants carried over from the previous sub-containers. The variation of the color can be detected visually or trigger an alarm. To extend the useful life of the container, the bleach-fix sub-container contains activated charcoal to remove developing agent. Cartridge 100 is attached to the tanks of a small volume processor by means of pipes 10, 20, 30, 40 and 50. Each one of these pipes may be one or more pipes, e.g., two, one for supply and one for return, depending on the means of cycling the chemistry into and out of the tanks. At least a part of the walls of this last sub-container can be transparent, so that the color of the resin can be viewed or monitored by a suitable sensor.

The system of the invention has the following advantages.

It allows the end of the life of chemical cartridge to be detected via the content of the final wash tank;

It is simple and inexpensive;

It provides an indication of the state of the squeegees; a quick change of the resin color is indicative of poor squeegeeing;

It allows to get prints that do not stain any quicker than they would in demineralized water.

This system may be combined with any of the detection methods that could be used in the sub-containers of such an equipment, with a view to detecting particularly the usefulness or end of usefulness of the cartridge.

The following Example is included for a better understanding of the invention.

EXAMPLE

A cartridge such as represented in FIG. 1 was used. All sub-containers volume was 500 ml. ⅕ of the volume (100 ml) of liquid in the last stabilizer sub-container was replaced by a mixed bed of colored ion exchange resin Duolite MB 6113, sold by Fison's Scientific Equipment Bishop, Meadow Road, Loughborough, Heicestershire LEll ORG U.K. The plumbing of the cartridge was such that liquid circulated each sub-container of the cartridge from the processor tanks. Liquid entered the top of the cartridge and left at the bottom after having passed through the ion exchange resin in theaxe of the last wash tank and through activated charcoal for the bleach-fix tank. The processing baths were designed to be used with a certain volume processing a certain number of prints, before being discarded. There was no replenishment.

The first sub-container was filled with Ektacolor RA 4 developer replenisher; the second sub-container was filled with Ektacolor RA bleach-fix RA replenisher; and the last three sub-containers were filled with demineralized water. The cartridge was connected to a small volume processor.

Sheets of unexposed A4 Ektacolor Supra Paper were processed and samples of the processed sheets, after every 10 sheets, were taken and incubated at 60° C. and 80% RH. The color of the ion exchange resin in the last tank was observed and recorded. Table 1 shows the change in yellow stain of the different samples as a function of the number of prints processed, along with the corresponding coloration of the resin.

TABLE 1

| No sheets processed | Yellow stain change | Resin color |
|---|---|---|
| 0 | 0.025 | blue-black |
| 10 | 0.026 | blue-black |
| 20 | 0.024 | Blue-black |
| 30 | 0.024 | Blue-black |
| 40 | 0.025 | Blue-black |
| 50 | 0.025 | Blue-black |
| 60 | 0.026 | Blue-black, top brown |
| 70 | 0.024 | Blue-black, 1/10 brown |
| 80 | 0.025 | Blue-black, 1/5 brown |
| 90 | 0.025 | Blue-black, 1/3 brown |
| 100 | 0.024 | Blue-black, 2/3 brown |
| 110 | 0.025 | Blue-black, 9/10 brown |
| 120 | 0.037 | all brown |
| 130 | 0.60 | all brown |

When the resin was completely changed in color, the prints showed signs of staining after accelerated keeping. This was the indication that the useful life of the cartridge was at an end.

The invention has been described in detail with particular reference to preferred embodiments thereof, but it will be understood that variations and modifications can be effected within the spirit and scope of the invention.

I claim:

1. In a method of processing imagewise exposed photographic materials, said method comprising treating said materials in a washing or stabilizing step in a processing machine comprising at least two processing tanks including a final stabilizing and washing tank, and a removable container containing at least one working strength solution and a final stabilizing and washing solution in separate sub-containers from which the processing tanks are fed, the improvement wherein the sub-container that contains the last stabilizing and washing solution comprises (a) an ion exchange resin and (b) an indicator means capable of undergoing a color change when the ion exchange resin is exhausted.

2. The method of claim 1 comprising the steps of:

(a) color development, (b) bleaching, and (c) fixing or a single bleach-fixing step in place of the separate bleaching and fixing steps, followed by said washing or stabilizing step.

3. The method of claim 1 comprising the steps of:

(a) development, and (b) fixing, followed by said washing or stabilizing step.

4. The method of claim 1 comprising a redox amplification or a redox developer-amplifier step prior to said washing or stabilizing step.

5. The method of claim 1 wherein the ion exchange resin is a cationic resin, an anionic resin, or a mixed bed of anionic and cationic resins.

6. The method of claim 5 wherein the indicator means is a pH indicator dye contained within said ion exchange resin.

7. The method of claim 1 wherein said processed photographic materials are color photographic papers.

8. In a photographic processing apparatus comprising processing tanks for holding processing solutions and a removable container containing at least one working strength processing solution and a stabilizing and washing solution in separate sub-containers therein from which the processing tanks are fed, the improvement wherein the sub-container that contains the last stabilizing and washing solution comprises (a) an ion exchange resin and (b) an indicator means capable of undergoing a color change when the ion exchange resin is exchanged.

9. The apparatus of claim 8 comprising means for circulating each processing solution to and from each respective pair of tanks and corresponding sub-containers.

10. The apparatus of claim 8 wherein said indicator means is a pH indicator dye.

11. The apparatus of claim 10 wherein said indicator means is contained within said ion exchange resin.

12. In a photographic processing solution cartridge comprising a container containing at least one working strength processing solution and a stabilizing-washing solution in separate sub-containers therein, the improvement wherein the last sub-container containing the stabilizing-washing solution contains an ion exchange resin and an indicator means capable of undergoing a color change when the ion-exchange resin is exhausted.

13. The cartridge of claim 12, further comprising a sensor for sensing the color change of the indicator.

14. The cartridge of claim 12 containing activated charcoal in a bleach-fixing or fixing sub-container.

15. The cartridge of claim 12 wherein said indicator means is a pH indicator dye.

16. The cartridge of claim 15 wherein said indicator means is contained within said ion exchange resin.

17. The cartridge of claim 12 wherein said ion exchange resin is a cationic resin, an anionic resin, or a mixed bed of anionic and cationic resins.

* * * * *